US010121405B2

(12) United States Patent
Kim et al.

(10) Patent No.: US 10,121,405 B2
(45) Date of Patent: Nov. 6, 2018

(54) DISPLAY APPARATUS INCLUDING A DISPLAY PANEL AND DRIVING DEVICE AND METHOD OF DRIVING THE SAME

(71) Applicant: SAMSUNG DISPLAY CO., LTD., Yongin-si, Gyeonggi-do (KR)

(72) Inventors: Jongsoo Kim, Yongin-si (KR); Sehyuk Park, Yongin-si (KR); Woomi Bae, Yongin-si (KR); Myungho Lee, Yongin-si (KR); Myoungseop Song, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/204,944

(22) Filed: Jul. 7, 2016

(65) Prior Publication Data

US 2017/0061858 A1 Mar. 2, 2017

(30) Foreign Application Priority Data

Aug. 31, 2015 (KR) ..... 10-2015-0123193

(51) Int. Cl.
*G09G 5/00* (2006.01)
*G09G 3/20* (2006.01)

(52) U.S. Cl.
CPC ..... *G09G 3/2092* (2013.01); *G09G 2330/02* (2013.01); *G09G 2380/02* (2013.01)

(58) Field of Classification Search
CPC . G09G 2380/02; G09G 3/2092; G06F 1/1616
USPC ..... 345/211
See application file for complete search history.

(56) References Cited

U.S. PATENT DOCUMENTS

| | | | | |
|---|---|---|---|---|
| 8,805,441 | B1 | 8/2014 | Nasserbakht et al. | |
| 2002/0055938 | A1* | 5/2002 | Matsuo | G09B 5/02 |
| 2003/0020701 | A1* | 1/2003 | Nakamura | G06F 1/1615 345/204 |
| 2003/0198008 | A1 | 10/2003 | Leapman et al. | |
| 2004/0070633 | A1* | 4/2004 | Nakamura | G06F 3/1423 715/860 |
| 2004/0155833 | A1* | 8/2004 | Ishii | G06F 3/1431 345/1.1 |
| 2005/0200559 | A1* | 9/2005 | Koyama | G06F 3/147 345/1.1 |

(Continued)

FOREIGN PATENT DOCUMENTS

| | | | |
|---|---|---|---|
| KR | 2003-0082913 | A | 10/2003 |
| KR | 10-2010-0016776 | A | 2/2010 |
| KR | 10-2013-0055263 | A | 5/2013 |

*Primary Examiner* — Adam J Snyder
(74) *Attorney, Agent, or Firm* — Lewis Roca Rothgerger Christie LLP

(57) ABSTRACT

A display apparatus includes a display panel having a first connector, and a driving device having a second connector configured to electrically connect to the first connector, wherein the display panel includes a connection state confirmation unit configured to output a connection state signal including connection information between the first connector and the second connector, and wherein the driving device includes a first power supply configured to supply power to the display panel when the connection state signal includes the connection information that a connection state between the first connector and the second connector.

12 Claims, 9 Drawing Sheets

(56) References Cited

U.S. PATENT DOCUMENTS

| | | | | |
|---|---|---|---|---|
| 2005/0206580 | A1* | 9/2005 | Koyama | G09G 5/006 345/1.1 |
| 2006/0103641 | A1* | 5/2006 | Marhefka | G02F 1/1345 345/204 |
| 2006/0192729 | A1* | 8/2006 | Cantatore | G09G 3/3677 345/55 |
| 2009/0195496 | A1* | 8/2009 | Koyama | G09G 5/003 345/107 |
| 2009/0219271 | A1* | 9/2009 | Bandel | G06F 1/1626 345/211 |
| 2013/0127799 | A1 | 5/2013 | Lee | |
| 2013/0135276 | A1* | 5/2013 | Yamamoto | G09G 3/20 345/211 |
| 2013/0265259 | A1* | 10/2013 | Jung | G06F 3/1423 345/173 |
| 2014/0184904 | A1 | 7/2014 | Lam et al. | |

* cited by examiner

DISPLAY APPARATUS INCLUDING A DISPLAY PANEL AND DRIVING DEVICE AND METHOD OF DRIVING THE SAME

CROSS-REFERENCE TO RELATED APPLICATION

This application claims priority to, and the benefit of, Korean Patent Application No. 10-2015-0123193, filed on Aug. 31, 2015 in the Korean Intellectual Property Office, the disclosure of which is incorporated herein in its entirety by reference.

BACKGROUND

1. Field

One or more exemplary embodiments relate to a display apparatus and a method of driving the same 2. Description of the Related Art As flexible display technologies and rollable display technologies are developed, a display panel having a relatively large screen becomes portable.

Using the above technologies, a user may carry a portable display panel, and can connect the portable display panel to a corresponding driving module/driving device to view an image at a location where the driving module is installed.

Here, confirming whether the display panel and the driving module are correctly connected is a very important safety issue. When the display panel connectors and/or the driving module connectors are bent by an external force, or when the display panel and the driving module are not properly connected due to a user's inexperience or mistake, a short circuit may occur, which may cause a breakdown of the display panel or a fire in the display panel.

Information disclosed in this Background section was already known to the inventors before achieving the inventive concept or is technical information acquired in the process of achieving the inventive concept. Therefore, it may contain information that does not form prior art.

SUMMARY

One or more exemplary embodiments include a display apparatus to connect a display panel and a driving device to each other, or to separate a display panel and a driving device from each other.

One or more exemplary embodiments include a display apparatus configured to confirm whether a display panel and a driving device are properly connected, and to determine whether to supply signals from the driving device to the display panel according to whether connection is confirmed.

Additional aspects will be set forth in part in the description that follows and, in part, will be apparent from the description, or may be learned by practice of the presented embodiments.

According to one or more exemplary embodiments, a display apparatus may include a display panel including a first connector and a connection state confirmation unit, and a driving device including a second connector configured to electrically connect to the first connector and a first power supply, wherein the connection state confirmation unit is configured to output a connection state signal including connection information between the first connector and the second connector, and wherein the first power supply is configured to supply power to the display panel when the connection state signal includes the connection information indicating a connection state between the first connector and the second connector.

The first connector may include a plurality of first connecting points, and the second connector may include a plurality of corresponding second connecting points respectively corresponding to the first connecting points of the first connector.

The connection state confirming unit may be further configured to output the connection state signal including normal connection information when all the first connecting points are connected to the corresponding second connecting points.

The first power supply may be further configured to supply the power to the display panel when the connection state between the first connector and the second connector is normal, and prevent the supply of the power to the display panel when the connection state between the first connector and the second connector is defective.

The driving device may further include a controller configured to output a confirmation request signal to request the connection state between the first connector and the second connector.

The display panel may further include a second power supply configured to supply an other power to the display panel. The first power supply may be for supplying the power to pixels in a first display area of the display panel, and the second power supply may be for supplying the other power to pixels in a second display area of the display panel.

The display panel may further include a power supply permit signal line to connect the driving device to the second power supply, and the second power supply may be further configured to supply the other power to the display panel when a first voltage signal is supplied from the driving device to the display panel through the power supply permit signal line.

The first power supply may be for supplying the power to first ones of the pixels within a first distance from an edge of the display panel in a first direction; and the second power supply may be for supplying the other power to second ones of the pixels within a second distance from another edge of the display panel in a direction opposite to the first direction of the display panel.

The driving device may further include an image signal generator configured to supply an image signal to pixels of the display panel when the first power supply supplies the power to the display panel.

The display panel may further include an image signal generator configured to supply an image signal to pixels of the display panel when the display panel receives the power from the first power supply.

The display panel may further include a flexible display including a portion that is bendable or foldable.

The display apparatus may further include a display module connectable to an area of the display panel. The display panel may further include a rollable display panel that is configured to be rolled to cover the display module, the display module may be at a first position, the driving device may be at a second position that is a first distance from the first position, the first distance may be proportional to a length of a side edge of the display panel.

According to one or more exemplary embodiments, a display apparatus may include a plurality of pixels, an internal connector electrically connectable to an external connector, a connection state confirming unit configured to confirm a connection state of the internal connector and configured to output a connection state signal including information on the connection state, and a power transmitter configured to transmit power to respective ones of the pixels.

The display apparatus may further include a signal receiver configured to receive the connection state signal and a power supply configured to supply the power to the power transmitter when the connection state signal includes information indicating that the connection state between the internal connector and the external connector is normal.

The power supply may be further configured to supply the power to the power transmitter when the connection state between the internal connector and the external connector is normal, and cut off the supply of power when the connection state between the internal connector and the external connector is defective.

The internal connector may include a plurality of internal connecting points respectively corresponding to a plurality of external connecting points of the external connector.

The connection state confirming unit may be further configured to output the connection state signal when all the plurality of internal connecting points are connected to corresponding ones of the external connecting points of the external connector.

According to one or more exemplary embodiments, a driving method of a display apparatus, which may include a display panel including a first connector and a driving device including a second connector that is configured to be electrically connected to the first connector of the display panel, may include confirming a connection state between the first connector and the second connector, in the display panel, outputting a connection state signal from the display panel when the connection state between the first connector and the second connector is normal, and supplying power to the display panel by receiving the connecting state signal, in the driving device.

The outputting the connection state signal may include confirming the connection state between the first connector and the second connector as normal when all of a plurality of first connecting points of the first connector are connected to corresponding second connecting points of the second connector.

The driving method may include cutting off the power, which is greater than the first amount, from the display panel when the connection state between the first connector and the second connector is defective, wherein the supplying the power comprises supplying the power to the display panel when the connection state between the first connector and the second connector is normal.

BRIEF DESCRIPTION OF THE DRAWINGS

These and/or other aspects will become apparent and more readily appreciated from the following description of the exemplary embodiments, taken in conjunction with the accompanying drawings, in which.

DETAILED DESCRIPTION

Figure 1:
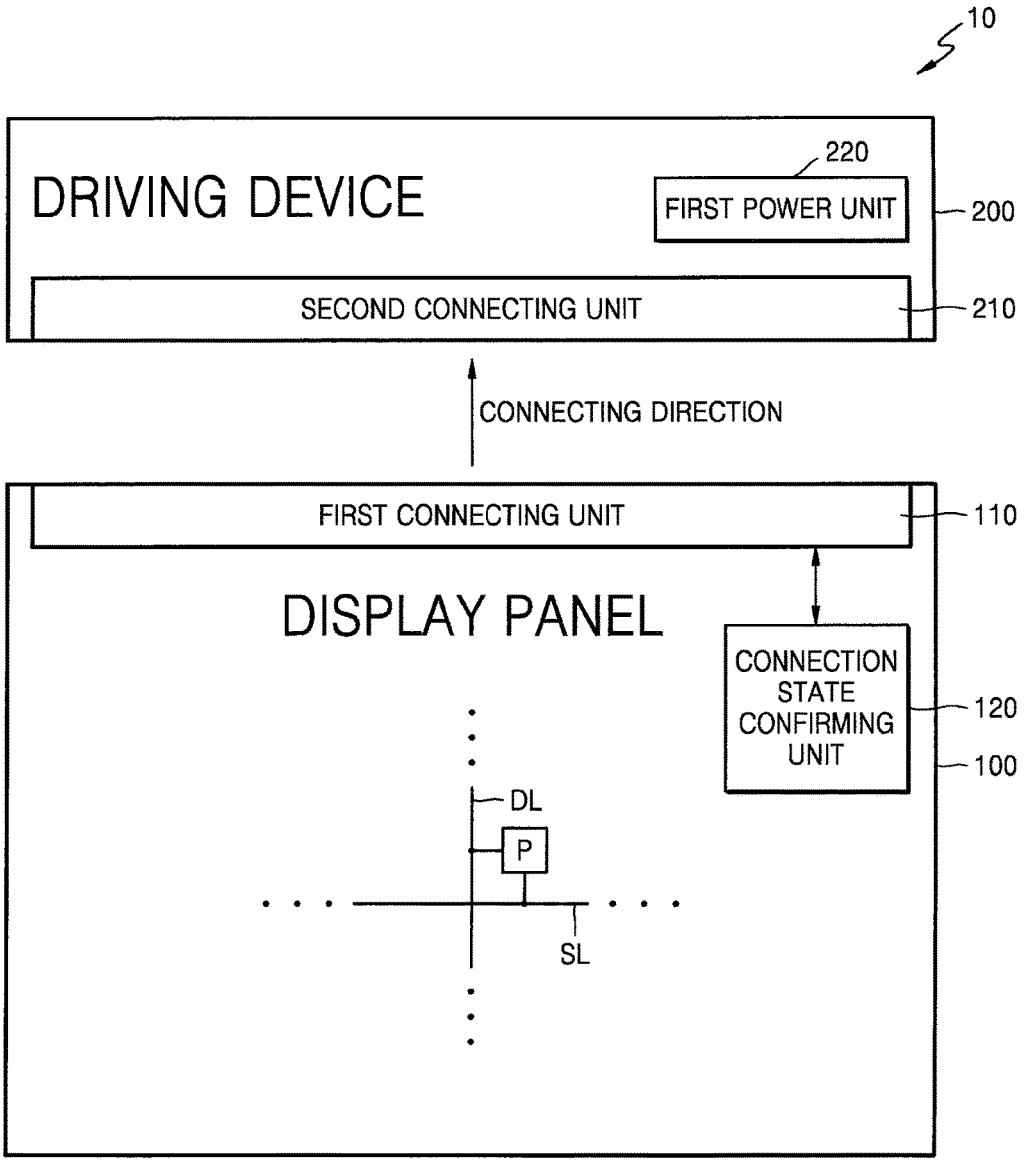
FIG. 1 is a view schematically illustrating a display apparatus according to an exemplary embodiment of the present inventive concept.

The present invention may be embodied in different forms and embodiments and should not be construed as being limited to the descriptions set forth herein. Accordingly, the exemplary embodiments are merely described below, by referring to the figures, to explain aspects of the present description.

It will be understood that although the terms "first," "second," "third," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, or section discussed below could be termed a second element, component, region, layer, or section, without departing from the spirit and scope of the present invention.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used herein specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Sizes of elements or components in the drawings may be exaggerated for convenience of explanation. In other words, because sizes and thicknesses of components in the drawings are arbitrarily illustrated for convenience of explanation, the present invention is not limited thereto.

Reference will now be made in detail to exemplary embodiments, examples of which are illustrated in the accompanying drawings, wherein like reference numerals refer to like elements or components throughout.

FIG. 1 is a view schematically illustrating a display apparatus 10 according to an exemplary embodiment of the present inventive concept.

Referring to FIG. 1, the display apparatus 10 according to an exemplary embodiment of the present inventive concept may include a display panel 100 and a driving device 200.

The display panel 100 may be a liquid crystal display panel, an organic light-emitting display panel, a flexible display, a 3D display, or an electrophoretic display. However, the present inventive concept is not limited thereto, and the display panel 100 may be various suitable electronic apparatuses configured to emit light to provide visible information. The organic light-emitting display panel will be illustrated as an example of the display panel 100.

The display panel 100 may include pixels P, and may display an image by using the pixels P. The pixels P may each include a plurality of sub-pixels displaying corresponding colors to thereby display various suitable colors. In this disclosure, the pixel P may be referred to as one of the sub-pixels. However, the present inventive concept is not limited thereto, and the pixel P may be a unit pixel including a plurality of sub-pixels. Although this disclosure illustrates one pixel P, the pixel P may be referred to as a plurality of sub-pixels, or as a unit pixel including a plurality of sub-pixels.

The pixel P may receive a scan signal from a scan line SL. and may also receive a data signal from a data line DL. The pixel P may emit an amount of light corresponding to the data signal according to timing corresponding to the scan signal.

Figure 2:
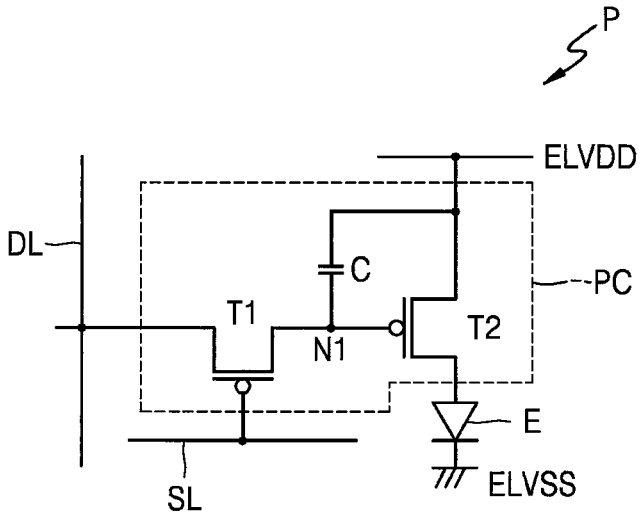
FIG. 2 is a circuit diagram illustrating a pixel of a display panel included in a display apparatus.

An exemplary operation or illustration of the pixel P will be explained with reference to FIG. 2. FIG. 2 is a circuit diagram illustrating the pixel P of the display panel 100 included in the display apparatus 10.

Referring to FIG. 2, the pixel P may include a light-emitting element E and a pixel circuit PC electrically connected to the light-emitting element E. The light-emitting element E may be an organic light-emitting diode OLED device including an anode electrode, a cathode electrode, and a light-emitting layer between the anode electrode and the cathode electrode.

A power voltage supplied to the pixel P may include a first power voltage ELVDD and a second power voltage ELVSS. The first power voltage ELVDD may be a driving voltage having a relatively high level, and the second power voltage ELVSS may be a driving voltage having a relatively low level. A level of a driving voltage supplied to each pixel P may be a difference between the levels of the first power voltage ELVDD and the second power voltage ELVSS. For example, when the level of the first power voltage ELVDD is about 6V and the level of the second power voltage ELVSS is about −4V, the level of the driving voltage supplied to each pixel P may be about 10V. When the level of the first power voltage ELVDD is increased and/or the level of the second power voltage ELVSS is lowered, the level of the driving voltage supplied to each pixel P increases.

The pixel circuit PC may include first and second transistors T1 and T2 and a capacitor. C. The first transistor T1 may include a gate electrode connected to the scan line SL, a first electrode connected to the data line DL, and a second electrode connected to a node N1.

The second transistor T2 may include a gate electrode connected to the node N1, a first electrode connected to a first power source to receive the first power voltage ELVDD, and a second electrode connected to the anode of the light-emitting element E.

The capacitor C may include a first electrode connected to the node N1 and a second electrode configured to receive the first power voltage ELVDD.

The light-emitting element E may include the anode electrode connected to the second electrode of the second transistor T2, and the cathode electrode to receive the second power voltage ELVSS from a second power source.

The first transistor T1 may transmit the data signal supplied from the data line DL to the first electrode of the capacitor C when the scan signal S is supplied to the first transistor T1 through the scan line SL. Accordingly, the capacitor C may be charged to have a voltage corresponding to the data signal, and a current corresponding to the voltage charged in the capacitor C may be transmitted to the light-emitting element E through the second transistor T2. Although FIG. 2 illustrates a structure of one pixel P including two transistors and one capacitor, the present inventive concept is not limited thereto. One pixel of other embodiments may include more than two thin film transistors and more than one capacitor. The pixel may include various suitable structures in which additional wirings may be included, and in which typical wirings may be omitted.

Referring back to FIG. 1, the driving device 200 may control the display panel 100 to display an image. The display panel 100 may output various suitable control signals and image signals that are used to drive the display panel 100.

The display panel 100 and the driving device 200 may be connectable, and may be electrically or physically disconnected from each other. That is, the display panel 100 and the driving device 200 may be two different apparatuses. Here, the display panel 100 and the driving device 200 may be electrically connected such that various electrical signals are transmitted between the display panel 100 and the driving device 200 to display an image on the display panel 100. To do this, the display panel 100 may include a first connecting unit 110 (e.g., a first connector 110), and the driving device 200 may include a second connecting unit 210 (e.g., a second connector 210).

The first connecting unit 110 may be included in the display panel 100, and the second connecting unit 210 may be included in the driving device 200. The first connecting unit 110 and the second connecting unit 210 may be electrically or physically connected to form one integrated body using various suitable methods such that the display panel 100 and the driving device 200 are electrically connected to each other.

For example, the first connecting unit 110 and the second connecting unit 210 may have a structure of a physically engaging type, for example, engaging two gear wheels. In another exemplary embodiment, one of the first connecting unit 110 and the second connecting unit 210 may have a latch-like type structure, and the other one of the first connecting unit 110 and the second connecting unit 210 may have a keeper-like type structure to lock the latch-like type structure. According to another exemplary embodiment, one of the first connecting unit 110 and the second connecting unit 210 may have a magnet, and the first connecting unit 110 and the second connecting unit 210 may be connected to each other using a magnetic force. According to another exemplary embodiment, the first connecting unit 110 and the second connecting unit 210 may be electrically connected to each other through a passage type structure to transmit electrical signals without a physical connection between the first connecting unit 110 and the second connecting unit 210. Besides the connection above, the first connecting unit 110 and the second connecting unit 210 may be connected to each other by using various suitable methods to transmit electrical signals between the first connecting unit 110 and the second connecting unit 210.

When the first connecting unit 110 and the second connecting unit 210 are properly connected to each other, various electronic signals may be transmitted and received between the display panel 100 and the driving device 200. Here, it is useful to confirm a connection state between the first connecting unit 110 and the second connection unit 210 to prevent or substantially prevent the occurrence of a breakdown, and to prevent or reduce a fire risk in an electronic apparatus. Also, in the case of a good connection state, the driving device 200 may supply power to the display panel 100 to drive the display panel 100. Therefore, the display panel 100 may include a connection state confirming unit 120, and the driving device 200 may include a first power unit 220 (e.g., a first power supply 220).

The connection state confirming unit 120 may confirm the connection state between the first connecting unit 110 and the second connecting unit 210, and may output a connection state signal including information regarding the connection state. According to the determination of the connection state confirming unit 120, when the first connecting unit 110 and the second connecting unit 210 are properly connected to each other, the first power unit 220 may supply power to the display panel 100. Operations of the connection state confirming unit 120 and the first power unit 220 will be explained with reference to FIGS. 3 and 4.

Figure 3:
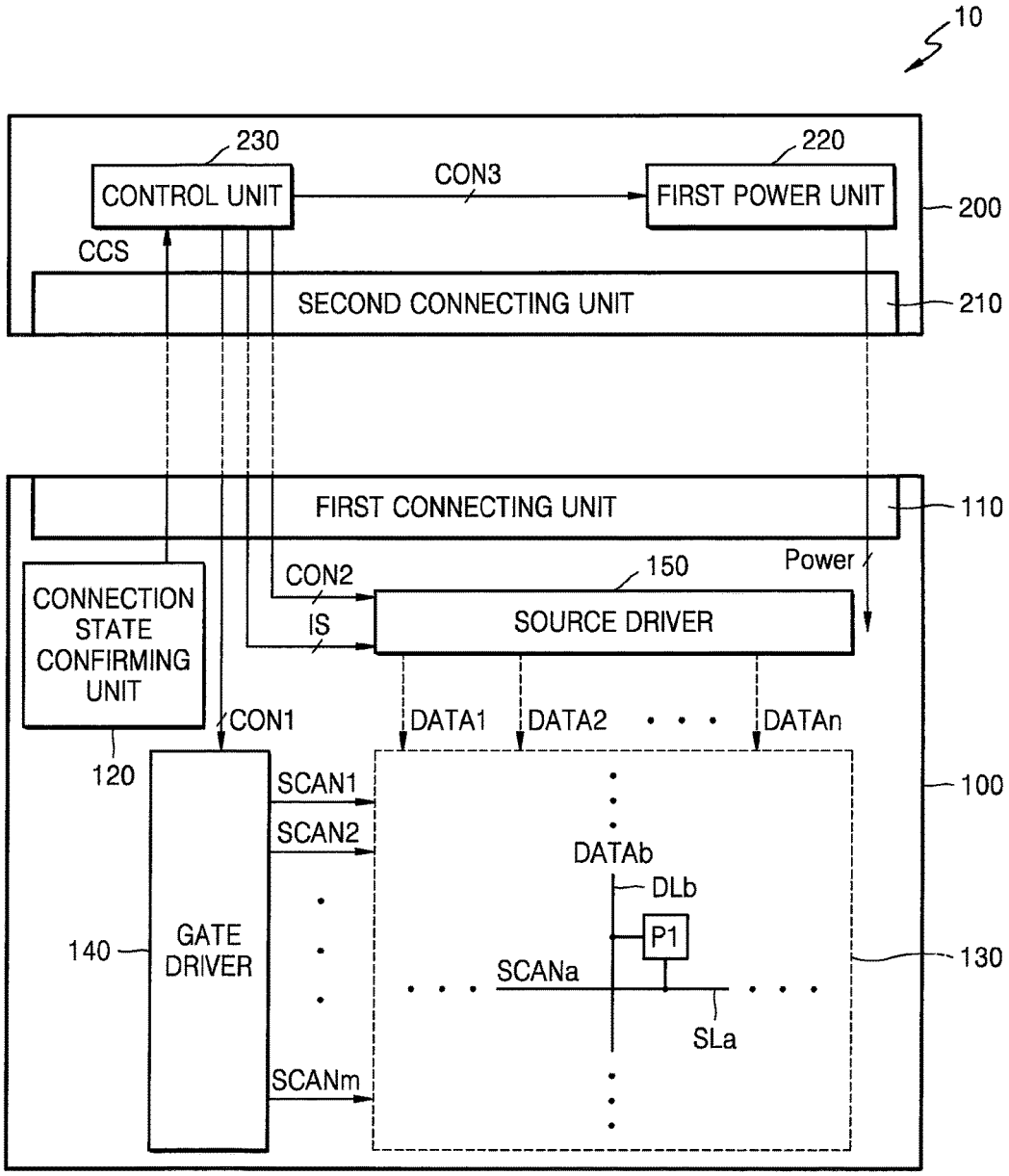
FIGS. 3 and 4 are views schematically illustrating an internal structure of a display panel and a driving device according to an exemplary embodiment of the present inventive concept.
Figure 4:
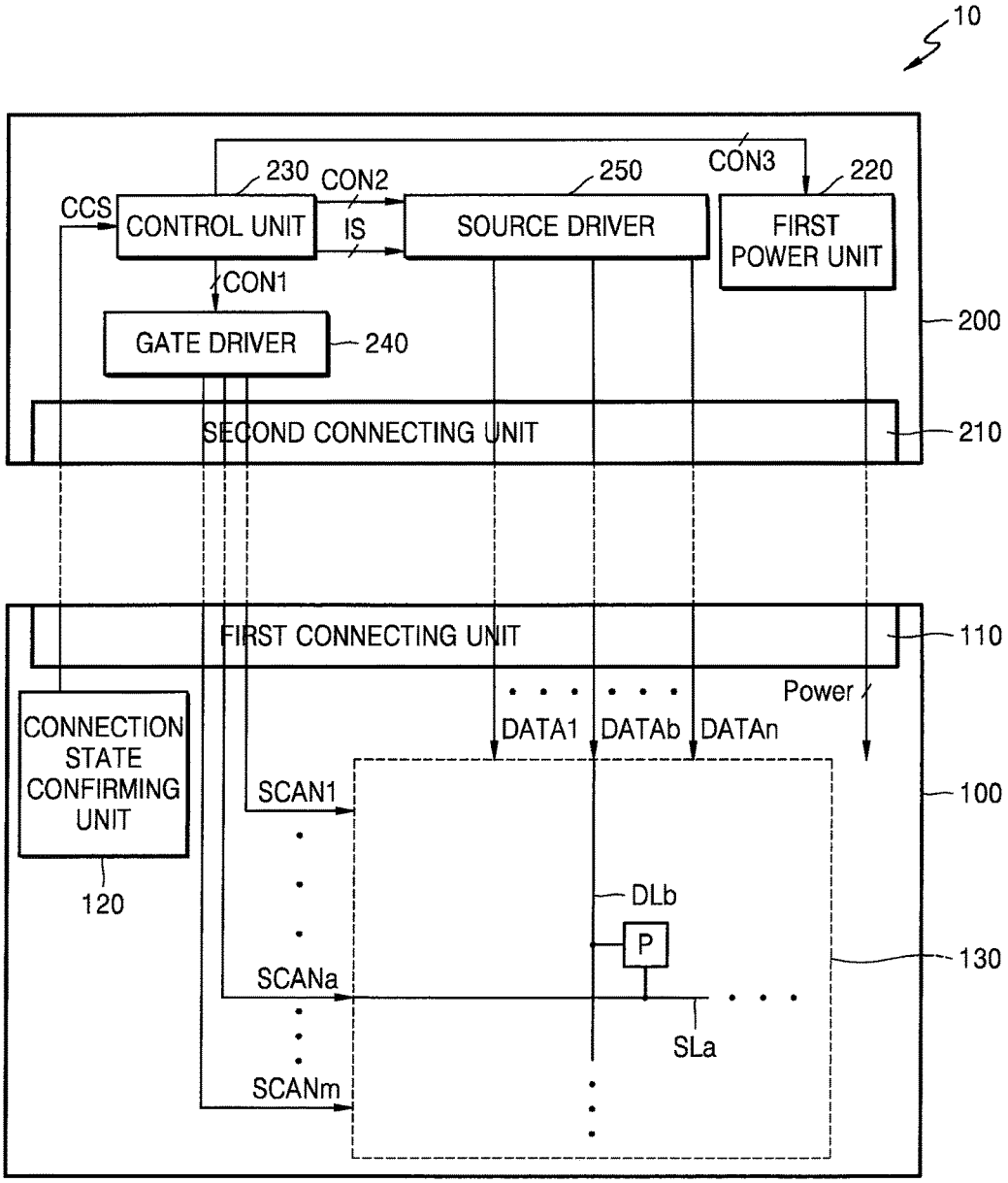

FIGS. 3 and 4 are views schematically illustrating an internal structure of the display panel 100 and the driving device 200 according to an exemplary embodiment of the present inventive concept. Components that are configured to generate the scan signal and the data signal to be supplied to the pixel P of the display panel 100 may be included in the display panel 100 or the driving device 200.

Referring to FIG. 3, a display area 130 of the display panel 100 may include the pixels P. The display panel 100 may include a gate driver 140 and a source driver 150. The driving device 200 may include a control unit 230 (e.g., a controller 230).

The control unit 230 may output signals to the display panel 100 to control the display area 130, the gate driver 140, the source driver 150, and the first power unit 220.

In some embodiments, the control unit 230 may output a first control signal CON1 to the gate driver 140. The first control signal CON1 may include a vertical synchronization signal and a horizontal synchronization signal. The first control signal CON1 may include control signals that are used for the gate driver 140 to output scan signals SCAN1 through SCANm, which are synchronized by the vertical synchronization signal and the horizontal synchronization signal.

The control unit 230 may output an image signal IS and a second control signal CON2 to the source driver 150. The second control signal CON2 may include control signals that are useful for the source driver 150 to output data signals DATA1 through DATAn corresponding to the image signal IS. The image signal IS may include image information that is used by the source driver 150 to output data signals DATA1 through DATAn. Here, the control unit 230 may generate the image signal IS by correcting an original image signal that is received from an external device.

According to an exemplary embodiment, the control unit 230 may include at least one processor. Accordingly, the control unit 230 may be included in a hardware apparatus, such as a microprocessor or a general computer system.

The display area 130 may include a plurality of pixels P. The display area 130 may include a plurality of scan lines SLs connected to the pixels P, the scan lines SLs extending in a row direction and being arranged in a column direction, and also a plurality of data lines DLs connected to the pixels P, the data lines DLs extending in the column direction and being arranged in the row direction. For example, as illustrated in FIG. 3, the display area 130 may include a first pixel P1 included in the plurality of pixels P. Here, the first pixel P1 may be disposed on an "a" row and a "b" column of the display area 130. The display area 130 may include an "a" scan line SLa connected to the pixels P on the "a" row, and a "b" data line DLb connected to the pixels P on the "b" column (e.g., first pixel P1). The first pixel P1 may be connected to both the "a" scan line Sla and the "b" data line DLb. Here, the first pixel P1 may receive an "a" scan signal SCANa through the "a" scan line Sla and a "b" data signal DATAb through the "b" data line DLb.

The gate driver 140 may output the scan signals SCAN1 through SCANm to the corresponding scan lines SLs. The gate driver 140 may output the scan signals SCAN1 through SCANm that are synchronized by the vertical synchronization signal and/or the horizontal synchronization signal.

The source driver 150 may output the data signals DATA1 through DATAn to the corresponding data lines DLs. The source driver 150 may output the data signals DATA1 through DATAn corresponding to the received image signal IS.

The connection state confirming unit 120 may confirm whether there is the connection state between the first connecting unit 110 and the second connecting unit 210, and may generate a connection state signal CCS including information regarding the connection state.

The connection state confirming unit 120 may confirm whether there is the connection state between the first connecting unit 110 and the second connecting unit 210 according to various suitable methods. For example, the connection state confirming unit 120 may generate a test current to flow to a plurality of positions of each of the first connecting unit 110 and the second connecting unit 210, and may detect resistance, electromagnetism, feedback current, and/or voltage of the test current to confirm whether the connection state exists. Also, the connection state confirming unit 120 may include an electromagnetism sensor, a luminance sensor, and/or a pressure sensor, and may confirm the connection state according to a detection result of the corresponding sensor(s).

The connection state confirming unit 120 may output the connection state signal CCS indicating a case in which the first connecting unit 110 and the second connecting unit 210 are correctly connected to each other, or indicating a case in which the connection state of the first connecting unit 110 and the second connecting unit 210 is defective (i.e., a case in which the first connecting unit 110 and the second connecting unit 210 are not correctly connected). For example, the connection state confirming unit 120 may output a first connection state signal having a first voltage, a first frequency, and/or a first pattern when the connection between the first connecting unit 110 and the second connecting unit 210 is correct, or may output a second connection state signal having a second voltage, a second frequency, and/or a second pattern when the connection state between the first connecting unit 110 and the second connecting unit 210 is defective. In some embodiments, the connection state confirming unit 120 may output the connection state signal CCS when the connection is correct and may not output the connection state signal CCS when the connection is defective.

The connection state confirming unit 120 may output the connection state signal CCS to the driving device 200. In some embodiments, the connection state confirming unit 120 may output the connection state signal CCS to the control unit 230.

The control unit 230 may output a third control signal CON3 to the first power unit 220. The third control signal CON3 may be a control signal to control whether to supply a power signal Power to the display panel 100, or whether to control an amount of power signal Power to be supplied to the display panel 100. Here, the power signal Power may include a first power voltage ELVDD signal and a second power voltage ELVSS signal, which are supplied to each pixel P.

The control unit 230 may output the third control signal CON3 according to the connection state information of the connection state signal CCS. That is, the control unit 230 may analyze the connection state information of the connection state signal CCS, may output the third control signal CON3 to control an amount power supplied to the display panel 100 when the first connecting unit 110 and the second connecting unit 210 are correctly connected to each other, and may output the connection state signal CCS either to terminate the supply of power to the display panel 100, or to supply a portion of the power to the display panel 100 when the connection is defective. When one of the first connection state signal and the second connection state signal is output according to the connection state confirmed by the connection state confirming unit 120, the control unit 230 may control the amount of the voltage, frequency, and/or pattern of the third control signal CON3 according to the connection state signal of the connection state confirming unit 120.

The control unit 230 may analyze the connection state signal CCS, and may output the first control signal CON1, the second control signal CON2, and the image signal IS when the first connecting unit 110 and the second connecting unit 210 are correctly connected to each other. That is, when the connection between the first connecting unit 110 and the second connecting unit 210 is defective, not only is the supplied power of the first power unit 220 controlled, but the first control signal CON1, the second control signal CON2, and the image signal IS are also controlled. Accordingly, the control unit 230 may output the first control signal CON1, the second control signal CON2, and the image signal IS to the display panel 100 when the first power unit 220 supplies the power signal Power to the display panel 100.

Referring to FIG. 4, the display area 130 of the display panel 100 may include the pixels P. In addition, the driving device 200 may include the control unit 230, a gate driver 240, and a source driver 250.

That is, components to generate scan signals and data signals to be supplied to the pixels P may be included in the display panel 100, as illustrated in FIG. 3, or may be included in the driving device 200, as illustrated in FIG. 4.

Here, the control unit 230 may output signals to control the first power unit 220, the gate driver 240, and the source driver 250. The control unit 230, the gate driver 240, and the source driver 250 may perform the same operations as described with reference to FIG. 3. The control signal CON1 and the control signal CON2 might not be transmitted to the display panel 100 through the first connecting unit 110 and the second connecting unit 210, but instead, the scan signals SCAN1 through SCANm and the data signals DATA1 through DATAn may be transmitted to the display panel 100 through the first connecting unit 110 and the second connecting unit 210. Also, the gate driver 240 and the source driver 250 may output the scan signals SCAN1 through SCANm and the data signals DATA1 through DATAn, respectively, when the first power unit 220 supplies the power signal Power to the display panel 100.

The display panel 100 and the driving device 200 of FIGS. 1 through 4 might only illustrate components relating to the embodiment of the present inventive concept to avoid potential ambiguity of characteristics of the present embodiments. Accordingly, in addition to the components illustrated in FIGS. 1 through 4, any suitable additional general component may be further included in the display panel 100 and/or the driving device 200.

Figure 5:
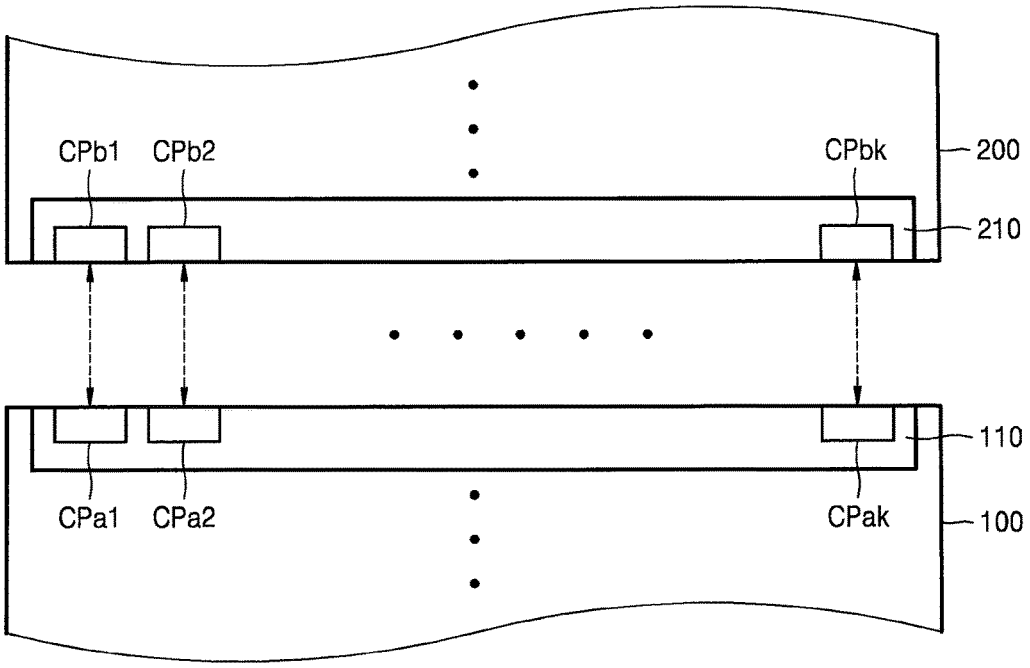
FIGS. 5 and 6 are views schematically illustrating connectors of a display panel and a driving device according to an exemplary embodiment.

FIG. 5 is a view schematically illustrating the first connecting unit 110 of the display panel 100 and the second connecting unit 210 of the driving device 200 according to an exemplary embodiment.

Referring to FIG. 5, the first connecting unit 110 may include a 1-1 connecting point CPa1 through a 1-k connecting point CPak, and the second connection unit 210 may include a 2-1 connecting point CPb1 through a 2-k connecting point CPbk.

The 1-1 connecting point CPa1 may correspond to the 2-1 connecting point CPb1, and the 1-2 connecting point CPa2 may correspond to the 2-2 connecting point CPb2. Similarly, the 1-k connecting point CPak may correspond to the 2-k connecting point CPbk. Here, "two connecting points corresponding to each other" indicates that the two connecting points are in a state to correctly transmit or receive an electronic signal through the two connecting points so that the first connecting unit 110 and the second connecting unit 210 are correctly connected to each other. That is, when the first connecting unit 110 and the second connecting unit 210 are correctly connected to each other, the electronic signal may be transmitted through the two corresponding connecting points. Here, the number of connecting points corresponding to a connecting point may be one or more.

Here, the connection state confirming unit 120 may determine a correct connection state of the first connecting unit 110 and the second connecting unit 210 when all the connecting points are connected to the corresponding connecting points, respectively, such as the 1-1 connecting points CPA1 through the 1-k connecting point CPak and the 2-1 connecting points CPb1 through the 2-k connecting point CPbk, and the connection state confirming unit 120 may generate the connection state signal CCS. That is, although most of the connecting points are correctly connected to the corresponding connecting points, it is possible to cause a breakdown, or even a fire, in the display panel 100 or in the driving device 200 when a signal such as power is supplied to the display panel 100 in a case in which the connection is defective in some portion of the connecting points. Accordingly, the connection state confirming unit 120 may determine that the connection between the first connecting unit 110 and the second connecting unit 210 is correct when all of the connecting points are connected to the corresponding connecting points, respectively. The connection state confirming unit 120 may confirm the connection state between connecting points selected according to a user or design preference among all the connecting points, and may generate the connection state signal CCS by determining the connection state of the first connection unit 110 and the second connecting unit 210 as a correct connection state when the connection state between the selected connecting points is correct.

Figure 6:
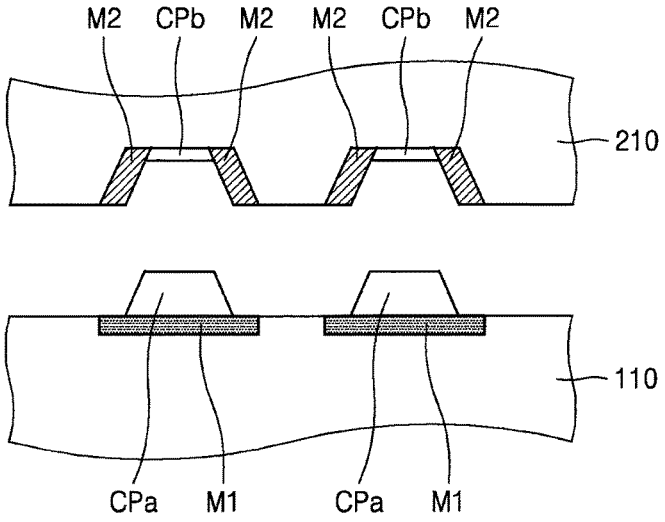

Referring to FIG. 6, a magnet may be disposed around or near portions of each of the 1-1 connecting points CPa1 through the 1-k connecting point CPak, and around or near each of the 2-1 connecting points CPb1 through the 2-k connecting point CPbk. In some embodiments, a first connection member M1 (e.g., a first connector M1) may be disposed around the respective first connecting points CPa of the first connecting unit 110, and a second connecting member M2 (e.g., a second connector M2) may be disposed around the respective second connecting points CPb of the second connecting unit 210.

As illustrated in FIG. 6, the first connecting points CPa may have a shape to occlude a shape of the second connecting points CPb. Here, the first connecting member M1 and/or the second connecting member M2 may include a material, such as a magnet. That is, the first connecting member M1 and the second connecting member M2 may include materials that respectively attract each other by a magnetic force. When the first connecting unit 110 and the second connecting unit 210 approach each other within a set distance (e.g., a predetermined distance), the first connecting unit 110 and the second connecting unit 210 may be connected to each other according to an attractive force generated between the first connecting member M1 and the second connecting member M2.

Figure 7:
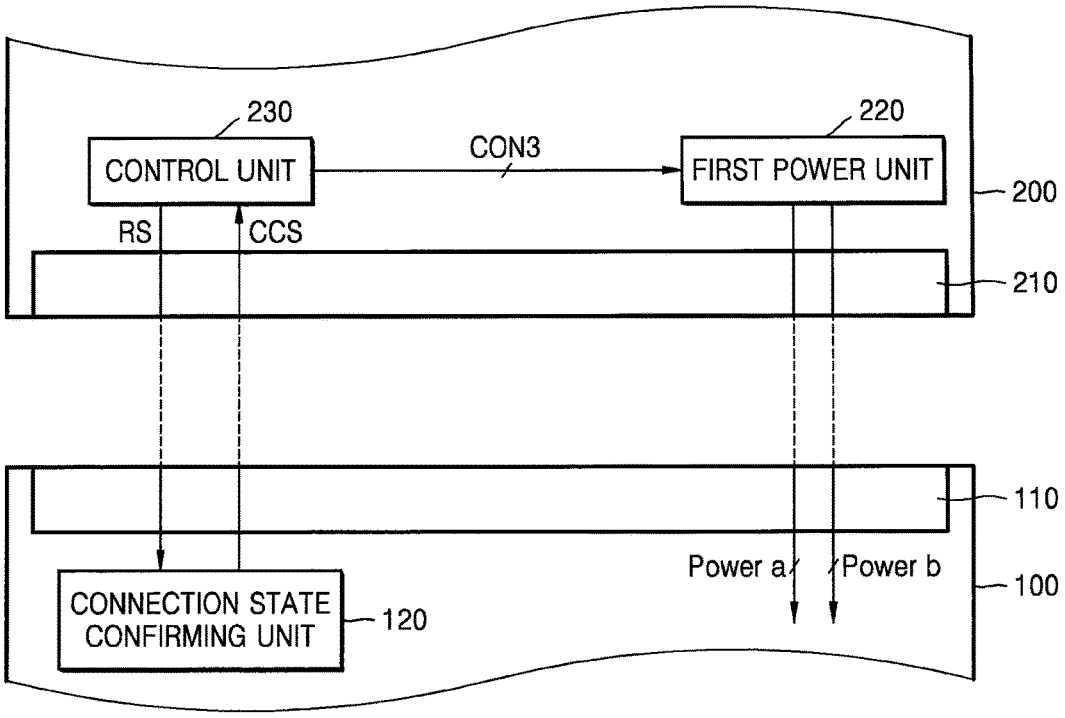
FIGS. 7 and 8 are views schematically illustrating an operation of supplying power to a display panel according to an embodiment of the present inventive concept.
Figure 8:
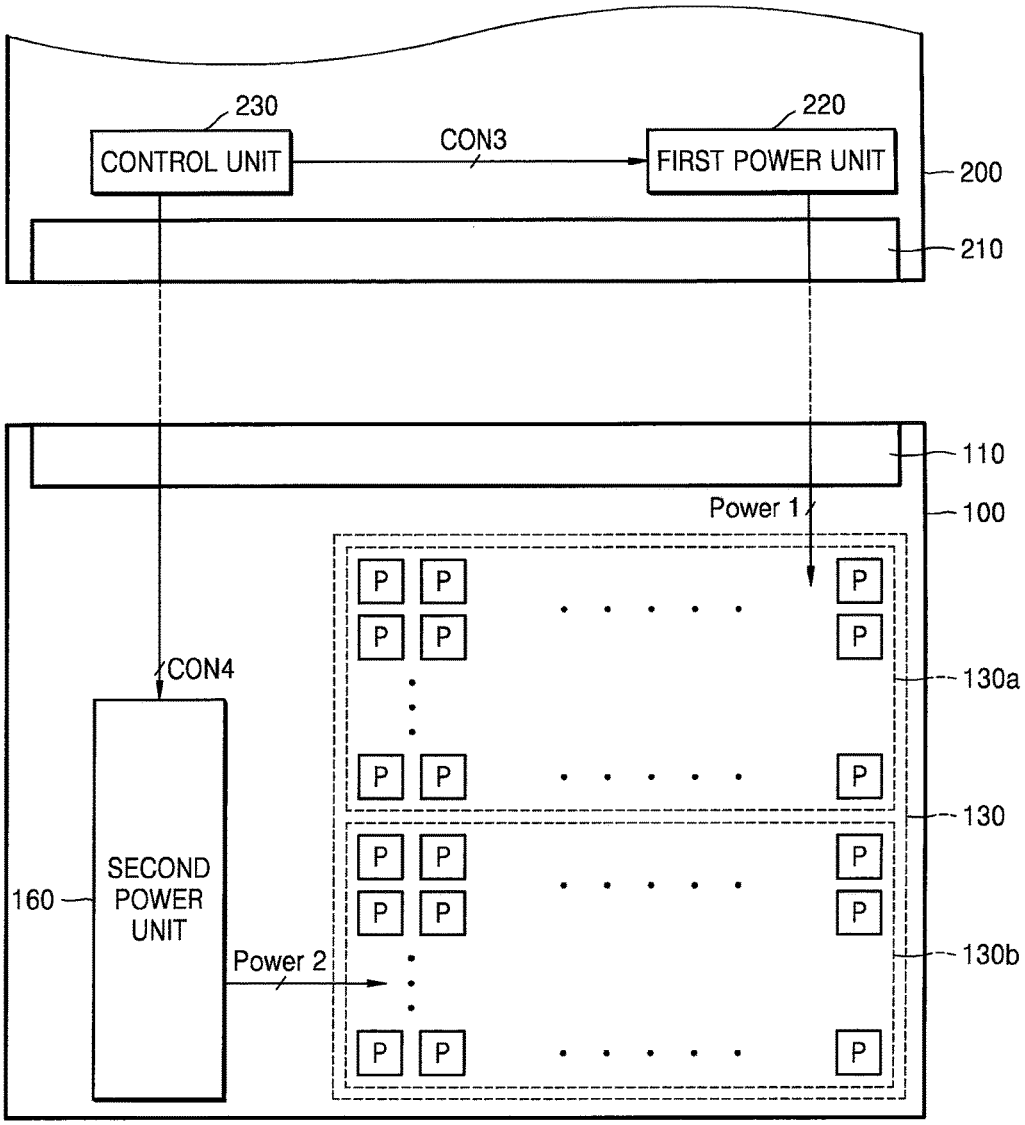

FIGS. 7 and 8 are views schematically illustrating an operation of supplying power to the display panel 100 according to an embodiment of the present inventive concept.

Referring to FIG. 7, the first power unit 220 may output an "a" power signal Power a and a "b" power signal Power b. Here, the "a" power signal Power a may be a power signal having an amount lower than a first amount, and the "b" power signal Power b may be a power signal having an amount lower than a second amount. For example, the "a" power signal Power a may be an enable signal to determine an on/off of an operation (e.g., a predetermined operation), and the "b" power signal Power b may be the first power voltage ELVDD signal or the second power voltage ELVSS signal to be supplied to the respective pixels P.

When the first connecting unit 110 and the second connecting unit 210 are correctly connected, the first power unit 220 may supply both the "a" power signal Power a and the "b" power signal Power b to the display panel 100. When the first connecting unit 110 and the second connecting unit 210 are not correctly connected but, rather, are defectively connected, the first power unit 220 may supply only the "a" power signal Power a to the display panel 100. That is, when the connection state of the first connecting unit 110 and the second connecting unit 210 is unstable, there is a high probability that a signal corresponding to a high-level voltage may cause the breakdown of, and/or fire in, an apparatus. Thus, the first power unit 220 may output a relatively low-level power signal having a low risk of a breakdown and fire regardless of the connection state, and may output a relatively high-level power signal having a high risk of breakdown and fire when the connection state of the first connecting unit 110 and the second connecting unit 210 is good and stable. An operation of the first power unit 220 may be controlled by the control unit 230.

Also, referring to FIG. 7, the control unit 230 may output a confirmation request signal RS to confirm the connection state between the first connecting unit 110 and the second connecting unit 210. The connection state confirming unit 120 may receive the confirmation request signal RS, and may output the connection state signal CSS by confirming the connection state between the first connecting unit 110 and the second connecting unit 210. When the confirmation request signal RS exists, the connection state confirming unit 120 may generate the connection state signal CCS by confirming the connection state between the first connecting unit 110 and the second connecting unit 210 upon receipt of the confirmation request signal RS, or may generate the connection state signal CCS according to other conditions, for example, may periodically generate the connection state signal CCS (e.g., during a predetermined period), in addition to the receipt of the confirmation request signal RS.

When the display panel is a large size panel, and when power is supplied to all the pixels from a single power unit, different voltage drop (IR) phenomena may occur according to differences between lengths of power supply lines that are connected to the respective pixels P. Although a same, or a substantially same, amount of power is supposed to be supplied to all the pixels P, amounts of power supplied to the respective pixels P may be different from one another. As a result of the different amounts of power, there may be problems in uniformity of light emitting from the pixels P of the display panel 100. To solve these problems, in the display apparatus 10 according to an exemplary embodiment of the present inventive concept, a power unit for supplying power may be included in the display panel 100 as well as the driving device 200.

Referring to FIG. 8, the display panel 100 may include a second power unit 160 (e.g., a second power supply 160). The first power unit 220 may output a first power signal Power 1, and the second power unit 160 may output a second power signal Power 2. The first power signal Power 1 and the second power signal Power 2 may have a same, or substantially the same, voltage level.

Here, the first power unit 220 may output the first power signal Power 1 to the pixels P in a first display area 130*a* of the display area 130, and the second power unit 160 may output the second power signal Power 2 to the pixels P in a second display area 130*b* of the display area 130. Here, the pixels P close to the first power unit 220, that is, the pixels P at a set distance (e.g., a predetermined distance) from an edge of the display panel 100 in a first direction, may receive a power signal from the first power unit 220. Similarly, the pixels close to the second power unit 160, that is, the pixels at a set distance (e.g., a predetermined distance) from an edge of the display panel 100 in a second direction that is opposite to the first direction, may receive a power signal from the second power unit 160. Accordingly, differences between lengths of power supply lines connected to the respective pixels P from the respective power units may be reduced, and the uniformity of the light emitted from the respective pixels P may be maintained to a certain level (e.g., a predetermined level) or above.

Here, a power supply timing of the second power unit 160 may be controlled by the control unit 230. That is, timings to supply power to the pixels P in the first display area 130*a* and to the pixels P disposed in the second display area 130*b* may be same or substantially the same. Accordingly, the control unit 230 may output a fourth control signal CON4 to the second power unit 160 to control the timing of the power supply by the second power unit 160. In the present disclosure, a conductive line configured to transmit the fourth control signal CON4 may be referred to as a power-supply permit signal line.

The power lines in the first display area 130*a* and the power lines in the second display area 130*b* may be different from one another, or may be disconnected from one another. In some embodiments, the first display area 130*a* may be driven by the first power signal Power 1 received from the first power unit 220, and the second display area 130*b* may be driven by the second power signal Power 2 received from the second power unit 160. Also, both of the first display area 130*a* and the second display area 130*b* may be driven according to the first power signal Power 1 and the second power signal Power 2, which are supplied together to the display area 130.

Figure 9:
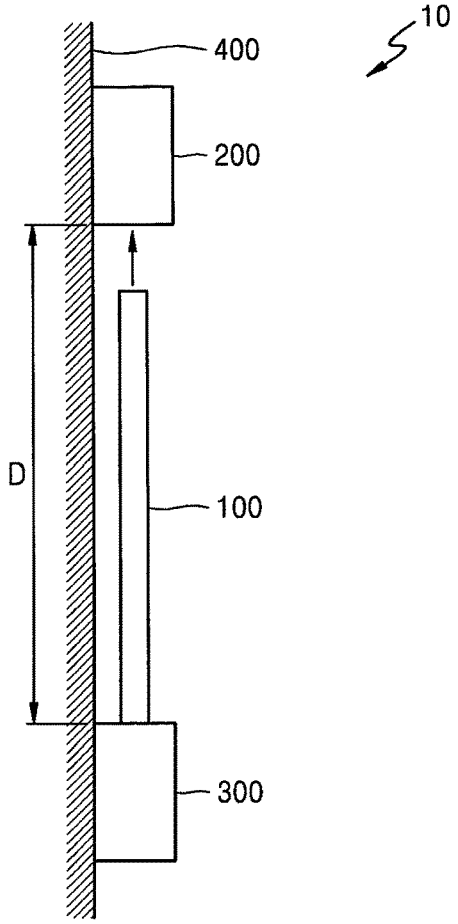
FIG. 9 is a view schematically illustrating a display apparatus installed in a fixed position.

FIG. 9 is a view schematically illustrating the display apparatus 10 installed in a fixed position.

The display apparatus 10 according to an exemplary embodiment of the present inventive concept may be a display apparatus to be installed at the fixed position. That is, referring to FIG. 9, the display apparatus 10 may further include a display module 300 that is connected to an edge of the display panel 100. The display module 300 and the driving device 200 may be attached to a fixed surface 400, for example, a wall, and may be spaced apart from each other by a first distance D. The display panel 100 may be a rollable display panel to be rolled to cover the display module 300. When a user does not use the display apparatus 10, the display panel 100 may be rolled into the display module 300. When the user uses the display apparatus 10, the display module 300 rotates such that the rolled display panel 100 may be spread out in a direction toward the driving device 200. When all the rolled portions of the display panel 100 are spread, the opposite edge of the display panel 100 may be connected to the driving device 200. A distance D may be the same as, or substantially the same as, a side edge of the display panel 100, so that the first connecting unit 110 and the second connecting unit 210 come in contact with each other when the rolled portion of the display panel 100 is spread. Accordingly, the first distance D may be the same as, substantially the same as, or may correspond to, a length of the side edge of the display panel 100. Therefore, when the display apparatus 10 is not used, it is possible to reduce a space that the display apparatus occupies.

Figure 10:
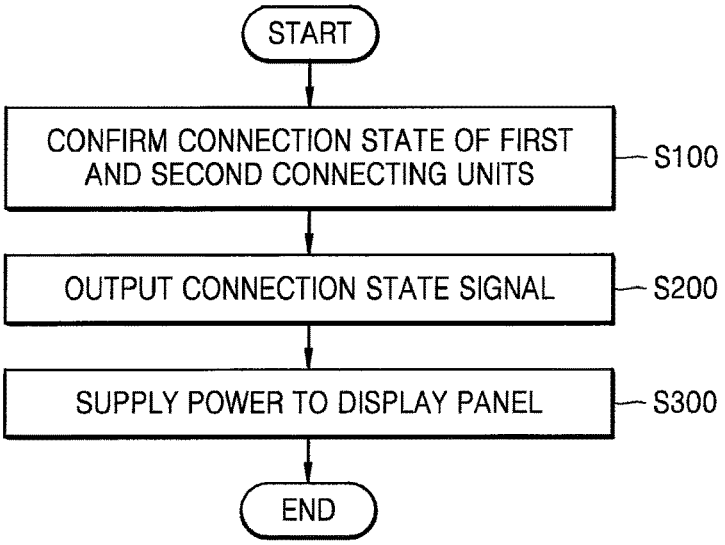
FIGS. 10 through 12 are flowcharts schematically illustrating methods of driving a display apparatus according to an embodiment of the present inventive concept.
Figure 11:
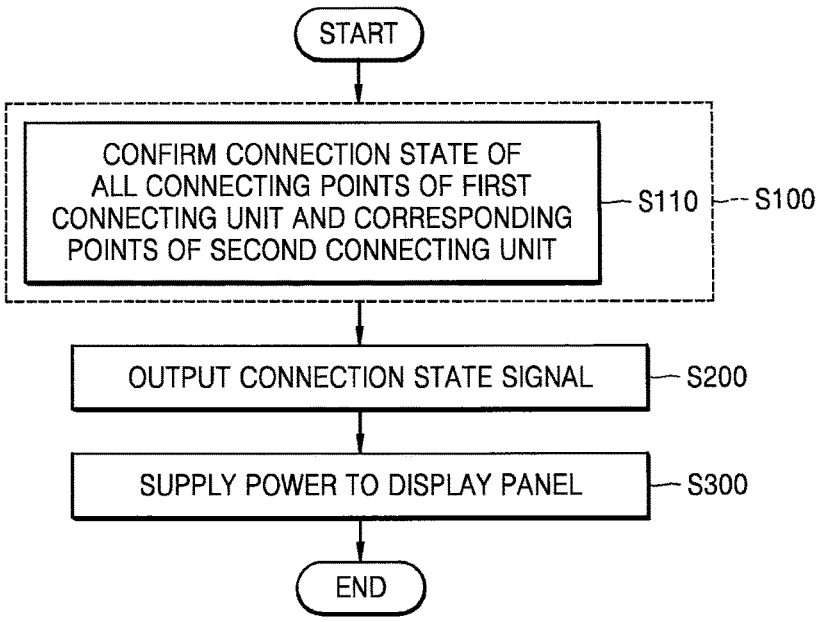
Figure 12:
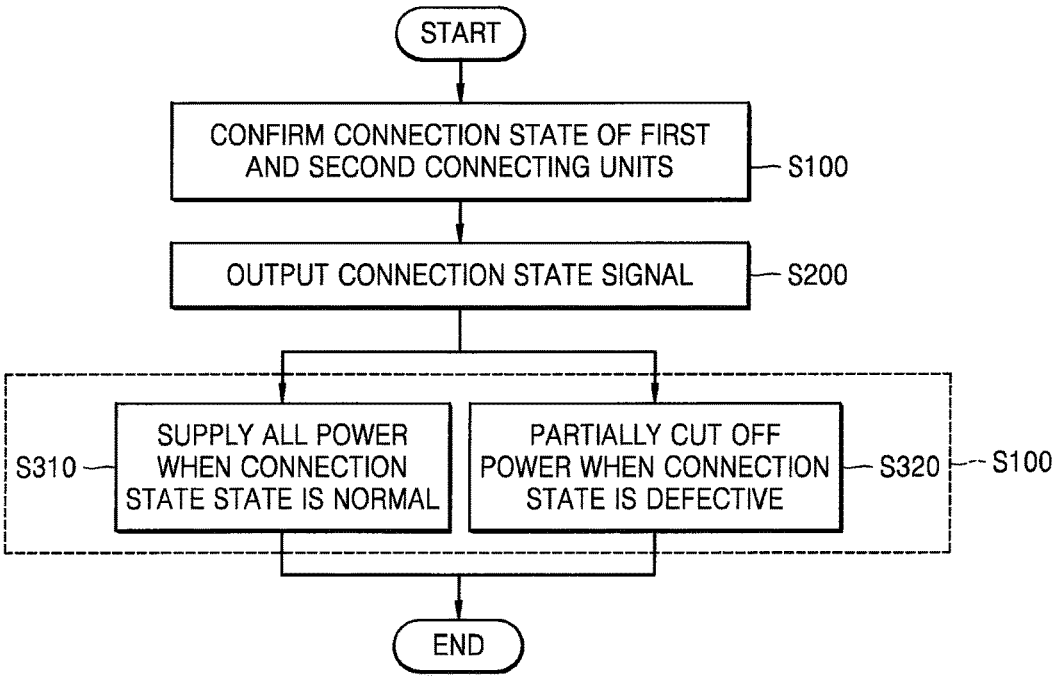

FIGS. 10 through 12 are flowcharts schematically illustrating methods of driving a display apparatus, according to embodiments of the present inventive concept. In the descriptions below, duplicate descriptions of FIGS. 1 through 9 may be omitted.

Referring to FIG. 10, a method of driving the display apparatus 10 according to an exemplary embodiment may include confirming the connection state of the first connecting unit 110 and the second connecting unit 210 at operation S100, outputting the connection state signal CCS at operation S200, and supplying power to the display panel 100 at operation S300.

In operation S100, the display panel 100 of the display apparatus 10 may be driven to confirm the connection state between the first connecting unit 110 and the second connecting unit 210, and to confirm whether the connection state is a state in which the power can safely be supplied to the display panel 100.

At operation S200, the display panel 100 may generate the connection state signal CCS including information on the confirmed connection state, and may output the generated connection state signal CCS to the driving device 200.

At operation S300, the driving device 200 may be driven to analyze the received connection state signal CCS, and to output the power signal Power to the display panel 100 when the connection state of the display panel 100 is correct.

Referring to FIG. 11, the display apparatus 10 is driven to confirm whether all the connecting points of the first connecting unit 110 are connected to the corresponding connecting points of the second connecting unit 210 at operation S110. The operation S110 may be included in the operation S100 of FIG. 10. That is, the display panel 100 may determine that the connection state is correct when all the connecting points of the first connecting unit 110 are connected to the corresponding connecting points of the second connecting unit 210. When more than one connecting point of the first connecting unit 110 are not connected to the corresponding connecting points of the second connecting unit 210, the display panel may determine that the connection state is defective. The display panel 100 may output the connection state signal CCS according to the determination.

Referring to FIG. 12, the display apparatus 10 is driven by the method of supplying all power to the display panel 100 when the connection state is correct or normal at operation S310, and by the method of supplying a portion of the power to the display panel 100 at operation S320. That is, the driving device 200 may output all the signals to the display panel 100 regardless of levels of the power signals when the connection state is correct. Also, the driving device 200 may cut off signals having a high voltage level, and may cut off signals that affect the display panel 100 and the driving device 200, and may output a remaining signal to the display panel 100 when the connection state is not correct.

As described above, an exemplary embodiment of the present inventive concept provides a display apparatus to electrically connect a display panel and a driving device to each other or to separate the display panel and the driving device from each other. In addition, a driving method of the display apparatus may confirm whether the display panel and the driving device are correctly connected to each other, and may determine whether a panel driving signal is supplied according to the confirmation. Therefore, an exemplary embodiment of the present inventive concept provides a display area and a driving device to drive the display area so that the display area and the driving device may be selectively connected to display an image according to a user preference. Also, by confirming a defective connection state between the display area and the driving device, which is a problem occurring in the display apparatus, problems such as breakdown of and/or fire in an apparatus may be prevented or substantially prevented in the display apparatus.

Regarding processes of a method according to the present embodiment, unless the present disclosure includes any description about a clear order of the processes or against the order of the processes, the processes may be performed in any suitable order. The processes described in this disclosure are just exemplary, and thus the present inventive concept is not limited to the processes. For conciseness of this disclosure, descriptions about typical electronic components, control systems, software, and other functional aspects of the above systems may have been omitted. Also, connections or connecting elements between components illustrated in the drawings are illustrated as functional connection and/or physical or circuit connection, these may be replaceable or may be represented with various suitable additional functional connection and/or physical or circuit connection in an apparatus. Also, unless there is "essential" or "important" in the descriptions, the component may not be an essential component to be applied to the apparatus according to the present embodiment.

As used herein, the singular forms "a" and "an" are intended to include the plural forms as well, unless the context clearly indicates otherwise. It will be understood that when the present disclosure describes "range," the range includes individual values within the range unless described otherwise in the present disclosure, and also the individual values within the range are inclusive.

It should be understood that exemplary embodiments described herein should be considered in a descriptive sense only and not for purposes of limitation. Descriptions of features or aspects within each exemplary embodiment should typically be considered as available for other similar features or aspects in other suitable exemplary embodiments.

While one or more exemplary embodiments have been described with reference to the figures, it will be understood by those of ordinary skill in the art that various suitable changes in form and details may be made therein without departing from the spirit and scope as defined by the following claims and their equivalents.

What is claimed is:

1. A display apparatus comprising:

a display panel comprising:

first pixels in a first display area;

second pixels in a second display area;

a first connector;

a connection state confirmation unit;

a gate driver configured to sequentially output scan signals to the first pixels and the second pixels;

a source driver configured to output data signals to the first pixels and the second pixels in synchronization with the scan signals; and a first power supply configured to supply power to the first pixels; and a driving device comprising:

a controller;

a second connector configured to electrically connect to the first connector; and a second power supply configured to supply power to the second pixels, wherein the connection state confirmation unit is configured to output a connection state signal to the controller, wherein the connection state signal indicating the first connector and the second connector are correctly connected to each other, wherein the controller is configured to receive the connection state signal and to enable the gate driver, the source driver, the first power supply and the second power supply in response to the connection state signal, and wherein when the first and second power supplies are enabled under control of the controller, the first power supply supplies the power to the first pixels at the same time when the second power supply supplies the power to the second pixels.

2. The display apparatus of claim 1, wherein the first connector comprises a plurality of first connecting points, and wherein the second connector comprises a plurality of corresponding second connecting points respectively corresponding to the first connecting points of the first connector.

3. The display apparatus of claim 2, wherein the connection state signal indicates that all the first connecting points are correctly connected to the corresponding second connecting points.

4. The display apparatus of claim 1, wherein the first power supply is further configured to:

supply the power to the first pixels of the display panel when a connection state between the first connector and the second connector is normal; and prevent supply of the power to the first pixels of the display panel when the connection state between the first connector and the second connector is defective; and wherein the second power supply is further configured to:

supply the power to the second pixels of the display panel when the connection state between the first connector and the second connector is normal; and prevent supply of the power to the second pixels of the display panel when the connection state between the first connector and the second connector is defective.

5. The display apparatus of claim 1, wherein the controller is configured to output a confirmation request signal to the connection state confirmation unit to request a connection state between the first connector and the second connector.

6. The display apparatus of claim 1, wherein the first display area is not same as the second display area.

7. The display apparatus of claim 1, wherein the display panel further comprises a power supply permit signal line to connect the controller of the driving device to the first power supply of the display panel, and wherein the first power supply is further configured to supply the power to the first pixels of the display panel when a first voltage signal is supplied from the controller to the first power supply through the power supply permit signal line.

8. The display apparatus of claim 1, wherein the first power supply is for supplying the power to the first pixels within a first distance from an edge of the display panel in a first direction; and wherein the second power supply is for supplying the power to the second pixels within a second distance from another edge of the display panel in a direction opposite to the first direction.

9. The display apparatus of claim 1, wherein the display panel further comprises a flexible display comprising a portion that is bendable or foldable.

10. The display apparatus of claim 9, further comprising:

a display module connectable to an area of the display panel, wherein the display panel further comprises a rollable display panel that is configured to be rolled to cover the display module, wherein the display module is at a first position, wherein the driving device is at a second position that is a first distance from the first position, the first distance being proportional to a length of a side edge of the display panel.

11. A driving method of a display apparatus comprising a display panel and a driving device, wherein the display panel comprising first pixels in a first display area, second pixels in a second display area, a first connector, a connection state confirmation unit, a gate driver, a source driver and a first power supply and wherein the driving device comprising a controller, a second connector and a second power supply, the method comprising:

confirming, via the connection state confirmation unit, a connection state between the first connector and the second connector, in the display panel;

outputting a connection state signal from the connection state confirmation unit to the controller, wherein the connection state signal indicating the first connector and the second connector are correctly connected to each other;

receiving, via the controller, the connection state signal;

outputting, via the controller, control signals to the gate driver, the source driver, the first power supply and the second power supply in response to the connection state signal;

supplying, via the first power supply, power to the first pixels in response to the control signal from the controller;

supplying, via the second power supply, power to the second pixels in response to the control signal from the controller at the same time when the first pixels are powered by the first power supply;

sequentially outputting, via the gate driver, scan signals to the first pixels and the second pixels in response to the control signal from the controller when the first pixels are powered by the first power supply and the second pixels are powered by the second power supply; and outputting, via the source driver, data signals to the first pixels and the second pixels in synchronization with the scan signals in response to the control signal from the controller when the first pixels are powered by the first power supply and the second pixels are powered by the second power supply.

12. The driving method of claim 11, further comprising:

cutting off the power from the first power supply to the first pixels and cutting off the power from the second power supply to the second pixels when the connection state between the first connector and the second connector is defective.

* * * * *